United States Patent [19]

Robertson

[11] 4,008,705

[45] Feb. 22, 1977

[54] FREESTANDING-FIREPLACE AND STOVE HEAT SHIELD

[76] Inventor: James H. Robertson, 11811 Cedar Lane, Kingsville, Md. 21087

[22] Filed: June 17, 1975

[21] Appl. No.: 587,650

[52] U.S. Cl. ..... 126/121; 165/55; 237/52

[51] Int. Cl.[2] ..... F24B 7/00

[58] Field of Search ..... 126/121, 67, 120, 140, 126/63; 237/52; 98/33 A; 165/53, 55, 56

[56] References Cited

UNITED STATES PATENTS

| | | | |
|---|---|---|---|
| 2,731,242 | 1/1956 | Borg et al. | 165/56 |
| 2,944,138 | 7/1960 | Goff | 165/55 |

FOREIGN PATENTS OR APPLICATIONS

| | | | |
|---|---|---|---|
| 1,344,299 | 4/1962 | France | 126/121 |
| 691,340 | 5/1929 | France | 126/140 |

*Primary Examiner*—John J. Camby
*Assistant Examiner*—Larry I. Schwartz
*Attorney, Agent, or Firm*—John F. McClellan, Sr.

[57] ABSTRACT

A heat shield for use with freestanding fuel-burning stoves, furnaces, fireplaces and the like, in the form of a modular panel assembly for securance over a wall in spaced relation to said freestanding unit; parallel-spaced, large area, anti-buckling specially-contoured partitions behind the front face of the panel assembly define plural vertical passages layered over the wall for air entering at an intake at the bottom and exiting at an exhaust at the top; louvers at the intake and exhaust align with the respective plural air passages and co-act with the interior partition structure of the invention to produce a sharp thermal gradiant between the front face and any wall protected from a source of heat by the invention, the front face of the panel assembly being hottest, and successive interior partitions and the wall protected being successively cooler as result of convective cooling combined with radiative shielding; special slot and attachment structure further prevents buckling from thermal expansion.

11 Claims, 11 Drawing Figures

FREESTANDING-FIREPLACE AND STOVE HEAT SHIELD

This invention relates generally to stove, furnace and fireplace heating and particularly to a heat shield for use with freestanding fireplaces and the like.

Freestanding fuel burning fireplaces and stoves are in rapidly increasing demand in the United States for new construction and particularly for post-construction installation. The cheerfulness and reliability of fire heat, as well as the economies for many people who have woodlots, contrast with the blandness, increasing cost and unreliability of conventional electric, hot-water, and hot-air heat.

However, freestanding fireplaces and stoves do present difficulties of their own. Both in new-construction and in post-construction, freestanding fireplaces and stoves must be spaced well out into the room to avoid local overheating of combustible wall structures. For unshielded installations, three feet on all sides is a typical minimum spacing. This requirement places a severe limitation on the minimum room size since the hearth may extend seven feet from the rear wall, depending on the type and size of fireplace.

In times past this was accepted as an unavoidable penalty. Today few people are accustomed to having a heating system protrude into the middle of the room, forcing placement of other furniture toward the walls, particularly when they would have it otherwise.

The best available heat shields permit the minimum spacing to be decreased to 24 inches; with these the hearth can still extend six feet into the room.

Representative of some of the prior art are stove-attached devices in the nature of spatter shields which have been provided. Typical of these is the device shown in U.S. Pat. No. 1,970,054 issued to M. E. Nordan on Sept. 14, 1934. Also, solid metallic shields have been known in the nature of the structures disclosed in U.S. Pat. No. 801,690 to E. Ralls, granted on Oct. 10, 1905. Built-in fireplaces and the like have been described with air passage structure attached and in contact with both fireplace and wall. U.S. Pat. No. 3,654,913 granted to Ray Derringer et al on Apr. 11, 1972 to an extent reflects the state of this art as of the present time.

However, to the present time no invention is known to afford the advantages of the present invention. Among the objects of the present invention are to provide a heat shield which:

safely permits installation of a freestanding fuel burning fireplace within six inches of a combustible building wall;

employs internal structure causing layered ascent of air resulting in maintenance of a sharp thermal gradient from face to wall, regardless of continued operation of the free-standing fuel burning fireplace over long periods of time;

efficiently converts the radiant heat of the freestanding fuel burning fireplace to convective heat, circulating the heated air in the room and replacing the layer of cool air normally found at levels below the heating element.

In brief summary given for cursive descriptive purposes only, the invention includes a vertical substantially floor-to-ceiling face having openings adjacent the bottom and top, extended-area plate structure in generally plane-parallel spaced relation behind the face and reaching substantially between the openings in the face, means for affixing the extended area plate structure in position relative to the face and a building wall while permitting thermal expansion and contraction from heat from a freestanding proximately adjacent source of heat, without local buckling and structure aligning airflow relative to the invention.

The above and other objects and advantages of the invention will become more readily apparent on examination of the following description including the drawings, in which like reference numerals indicate like elements:

The Figures are now referred to in detail.

THE PROBLEM

Figure 1:
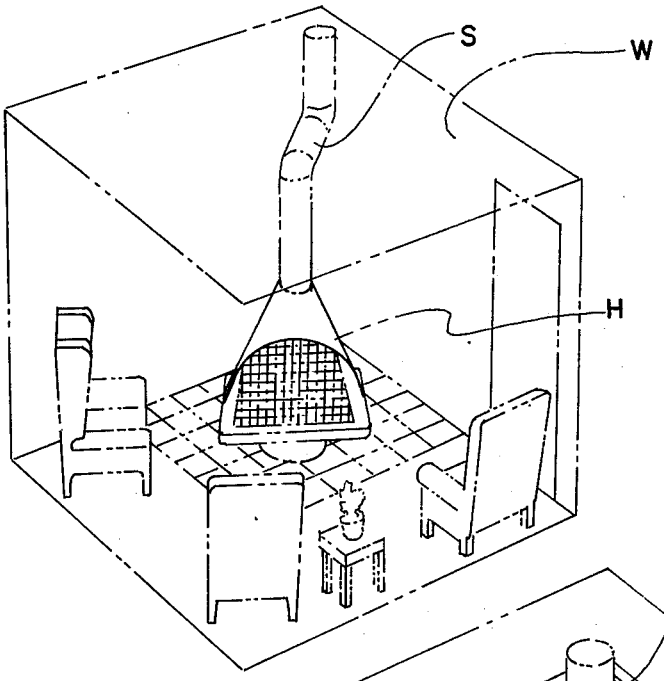
FIG. 1 is a perspective view of an old art room arrangement.

FIG. 1 diagrams a typical old-art stove or fireplace freestanding heater H installed in a small room having combustible or discolorable walls W. To prevent possibly igniting the walls, and at the least, to prevent toasting and discoloring the walls and heating of closets or the like behind the walls, freestanding fuel burning heating units such as H are prudently set far out in the room. In corner installations, the heating unit is usually equidistant from the walls forming the corner. Whatever the arrangement, in rooms of moderate size the necessary projection into the room of the freestanding fuel burning heating unit tends to dominate placement of furniture in the manner indicated. Further, in many cases of center-of-room freestanding fuel burning heater unit installation, such as when there is another room above of similar arrangement, it is undesirable to run the smoke pipe directly up through the middle of the ceiling, requiring an extensive lateral run of smokepipe S to a corner or to a wall.

Figure 2:
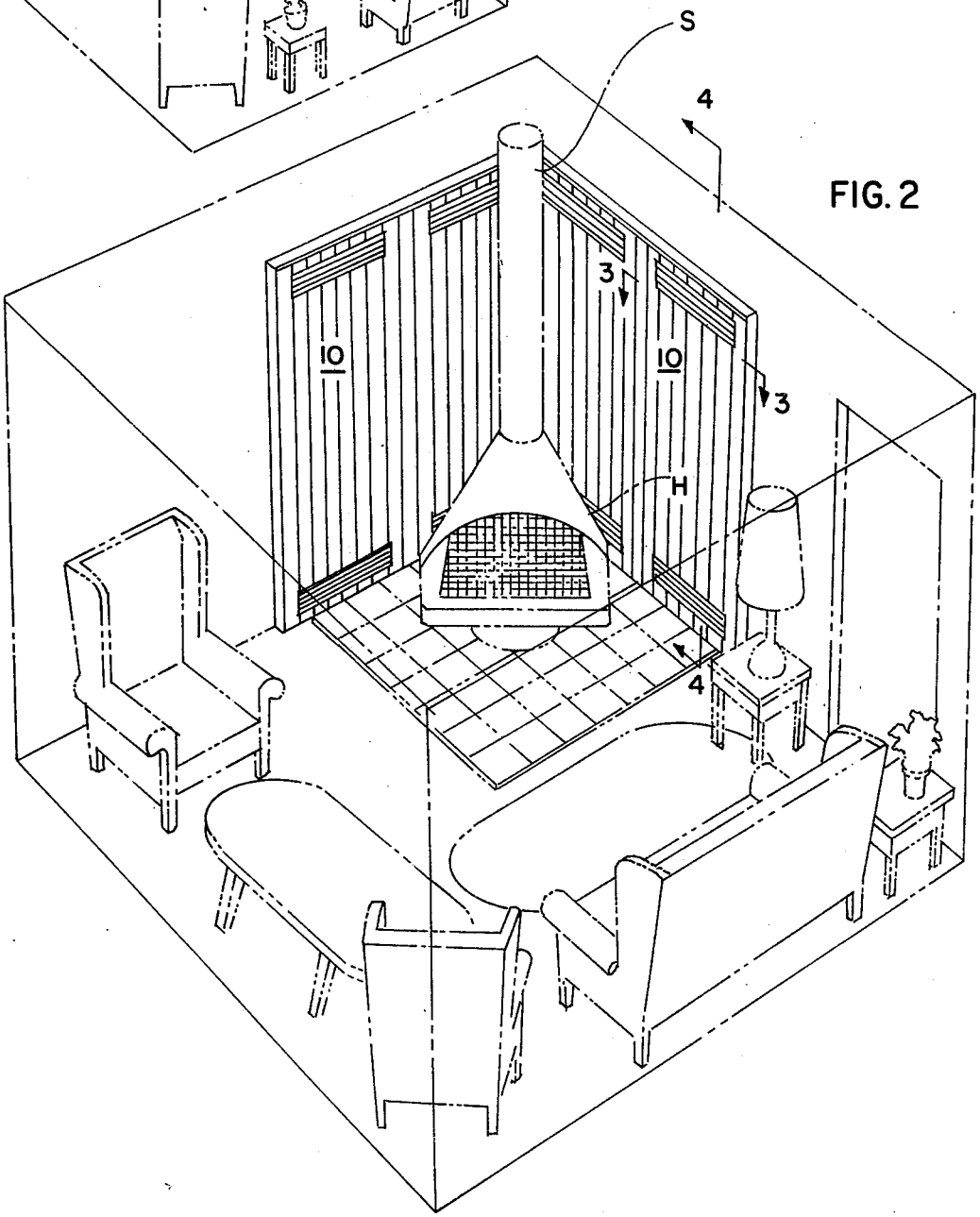
FIG. 2 is a perspective view of a room incorporating the present invention.

FIG. 2 indicates generally the improvement possible in space use when a freestanding fuel burning heating unit H can be set back almost to the wall or walls. Importantly also, as indicated, lateral run of the smokepipe S can be minimized or eliminated.

Wall covering panels 10 proximately spaced from the freestanding fuel burning heating unit according to the present invention make these improvements possible and additionally improve efficiency of transfer of heat from the freestanding full burning heating unit to room air. As a further advantage, the invention adds a decorative appearance to the heating unit installation and to the room as a whole.

Figure 3:
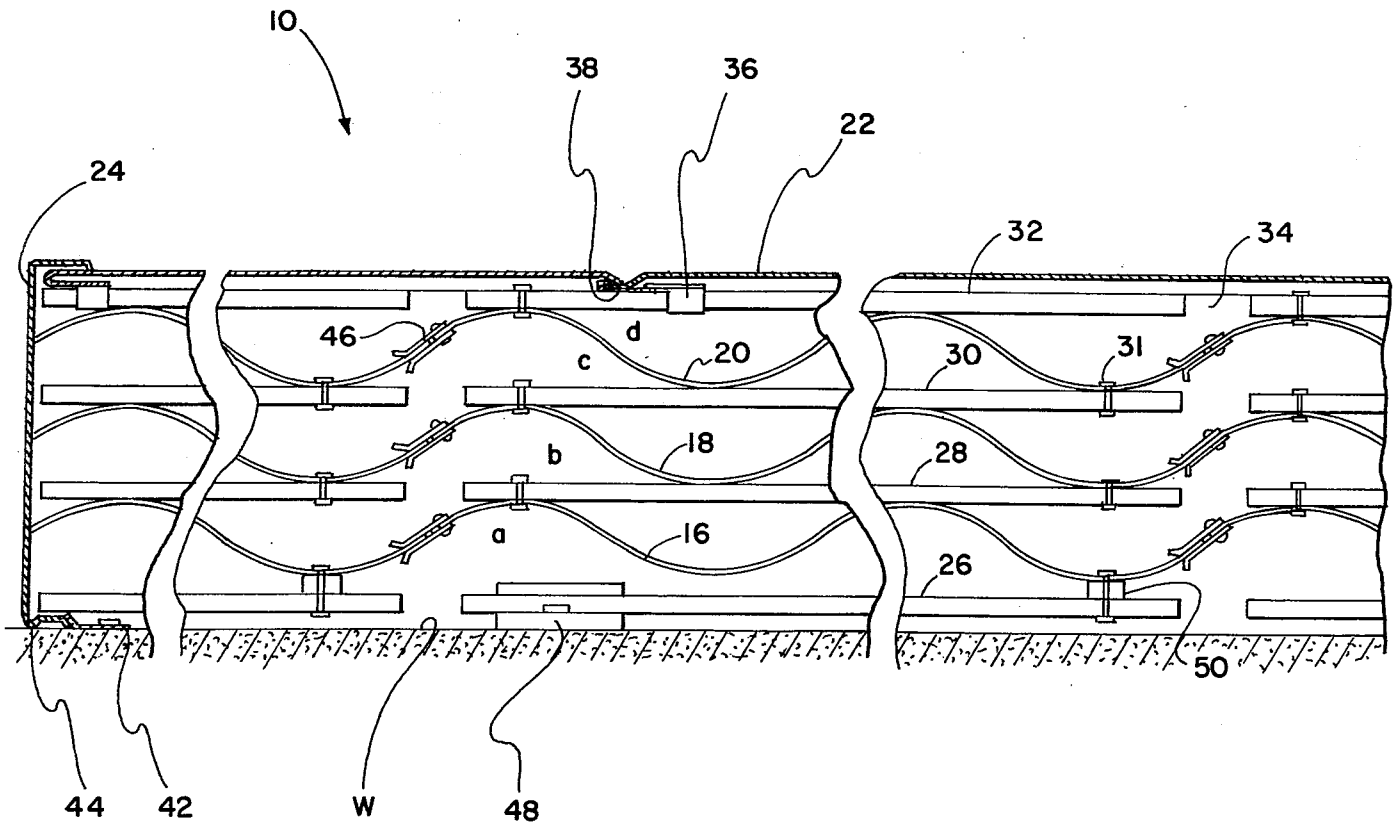
FIG. 3 is a cross section adapted from 3—3, FIG. 1.

FIG. 3, a fragmentary transverse section of a first embodiment panel assembly 10 installed, comprising portions of two panel sub-assemblies edge-joined as shown, forming four air passages *a*, *b*, *c*, *d*. The assembly consisting of transversely corrugated core panels 16, 18, 20 which may be 22-gauge sheet aluminum or the like, are held vertically with the convolutions in laterally corresponding parallel-spaced relation with any customary buildings interior-wall W by mounting means which also hold the metallic, baked enamel finish face panel 22 and end caps 24, and a similar top cap, not shown.

The mounting means include steel horizontal tie-bars 26, 28, 30, 32 which may be ⅛ × 1 inch straps. The tie-bars located between core panels (tie-bars 28 and 30) typically connect by rivets 31 alternately to a ridge of a core panel corrugation on one side of the tie bar and next to a ridge of a core panel corrugation on the other side of the tie bar, and so on in spaced series along the tie bars, minimizing conductive transfer between core panels. Each tie bar spans the approximate distance of one core panel; a space 34 is allowed for between tie bar ends for similar thermal expansion and conduction considerations. Flexure in the corrugations prevents the panels from buckling when heated.

Tie bars 32 on the front core panel 20 connect the corrugations with the face panel 22 by means of clips 36 gripping the tie bars and having lateral tabs which clamp flanges at 38, of the interlocking face members to the tie bar. End caps 24 are held to the wall of the building by wall mounted fastener clips 42 which engage the rear end-cap flanges 44. Top caps are similarly fitted and held. Conventional coupling clips 46 unite the laterally overlapped ends of the core panels.

The entire assembly mounts to the building wall by J-shaped bracket hangers 48 mounted on the wall and slidably supporting the rearmost tie bars 26 at intervals. Quarter-inch spacers 50 may be provided at the attachment points between the rearmost tie bar and the rear core panel to provide additional clearance at the building wall. With one-inch corrugations, the entire assembly totals only about three and one-half inches thick.

Figure 4:
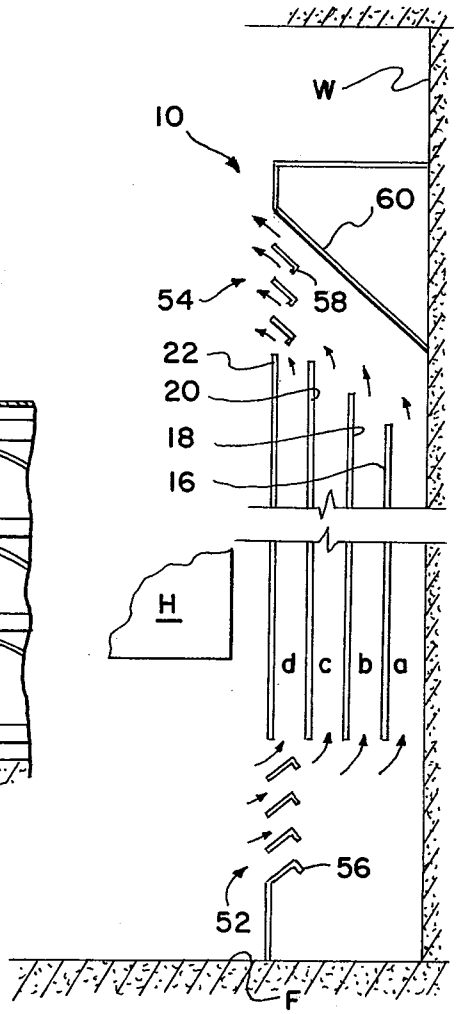
FIG. 4 is an elevational section taken at 4—4, FIG. 1.

FIG. 4, a fragmentary side elevation section diagram of the panel assembly 10 installed, indicates the vertical extent, relations and functions of the various components. Between the face panel 22 and the wall the relatively shorter core panels 16, 18, 20 form the four air passages *a*, *b*, *c*, *d*, layered over the wall W. The core panels extend from the top of an intake aperture 52 located in the face panel within two or three inches of the floor F or hearth of the room in which installed and the bottom of a corresponding exit aperture 54 located in the top of the face panel.

Louvres 56 in the intake are angled upward to the rear to direct the air into corresponding respective vertical passages, and to shield the wall W of the building from direct radiation from the freestanding heating unit H located adjacently above. Louvres 58 in the exit are angled upwardly to the front to direct the air outwards from the wall, in conjunction with a deflector 60 extending from the wall upwardly at an angle to the top of the exit aperture. The spacing and directions of the louvres form general continuations of the respective air passages.

In operation, it can be seen that each panel in turn radiatively shields those behind it and the wall, and that the convective effect of the heating draws room air upward in laminar flow, coolest at the rear, through the extended-area, corrugation bounded, core passages and cools all panels and the building wall.

The building wall is shielded most of all and is contacted by the least-heated air, that from the coolest level in the room, the surface of the floor. Surprisingly, it has been found by thermocouple-instrumented experiments on prototype structure similar to that described, an approximate two square foot central area of the face panel can be heated to about 480° F for approximately one-half hour by a radiant heat source proximately spaced therefrom a distance of one inch without raising the temperature of a wall of ordinary gypsum board 3½ inches behind the front panel higher than 95° F, the temperature of the ambient air and the building being otherwise at about 85° F.

It was discovered that extreme conditions of heating of the face panel can tend to cause some buckling of the face panel while heated, although construction of the remainder of the assembly, and the lower internal temperatures prevented problems there. Although the extreme heating deliberately applied in testing seldom occurs in use, a modified second embodiment of the invention was devised which eliminates all face panel buckling.

Figure 5:
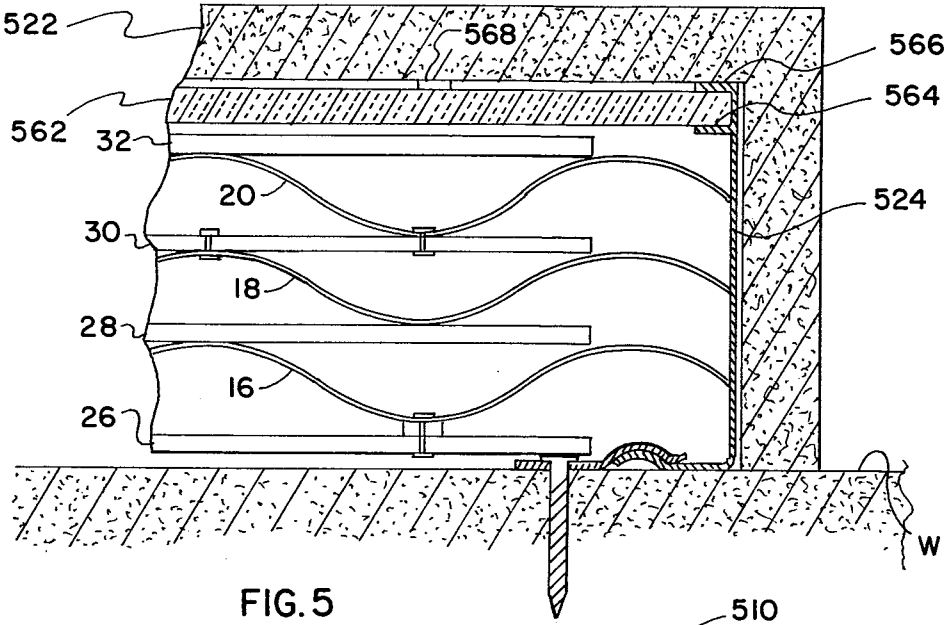
FIG. 5 is a fragmentary cross-section of a detail of a second embodiment of the invention.

FIG. 5, a fragmentary plan section details the second embodiment of the invention. The core panels 16, 18, 20, the tie bars 26, 28, 30, 32 and end cap 524 are mounted as before. However a quarter-inch thick asbestos board 562 is held immediately behind the face panel 522 between end-cap inwardly turned flanges 564 and 566 and extends the full width of the panel assembly, resting on the floor or hearth of the building.

The face panel is of ceramic material such as the commonly available half-inch thick brick facing and is held to the asbestos board by any common high-temperature or furnace cement 568 or by epoxy cement or by other ordinary means. The face panel preferably covers the end caps, as indicated, for decorative reasons.

Figure 6:
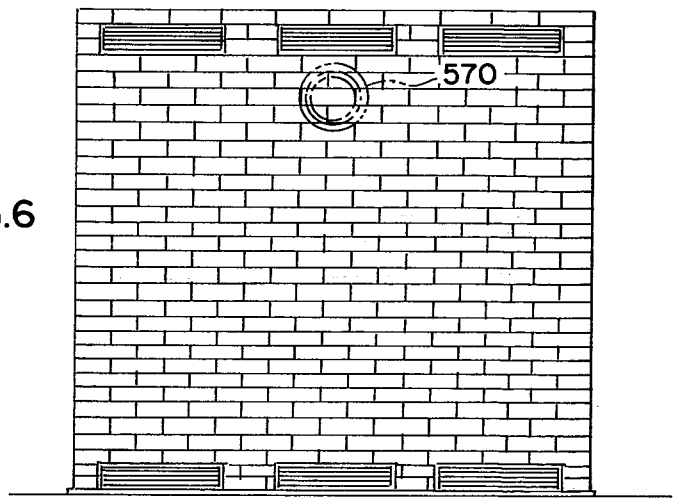
FIG. 6 is a front elevation of an embodiment of the invention.

FIG. 6 shows a panel assembly 510 finished with brick facing. The dotted lines at 570 indicate that a smoke pipe can safely and easily be installed through any embodiment of this invention.

Figure 7:
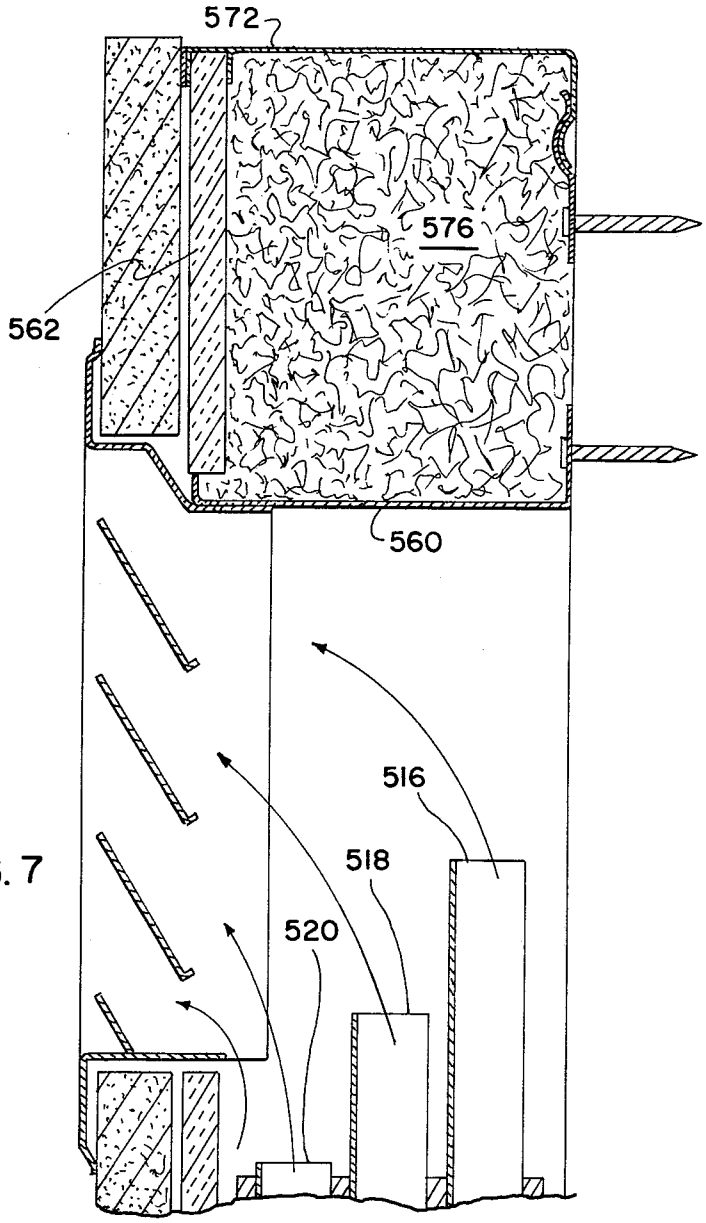
FIGS. 7 and 8 are upper and lower fragmentary elevational details of the second embodiment.
Figure 8:
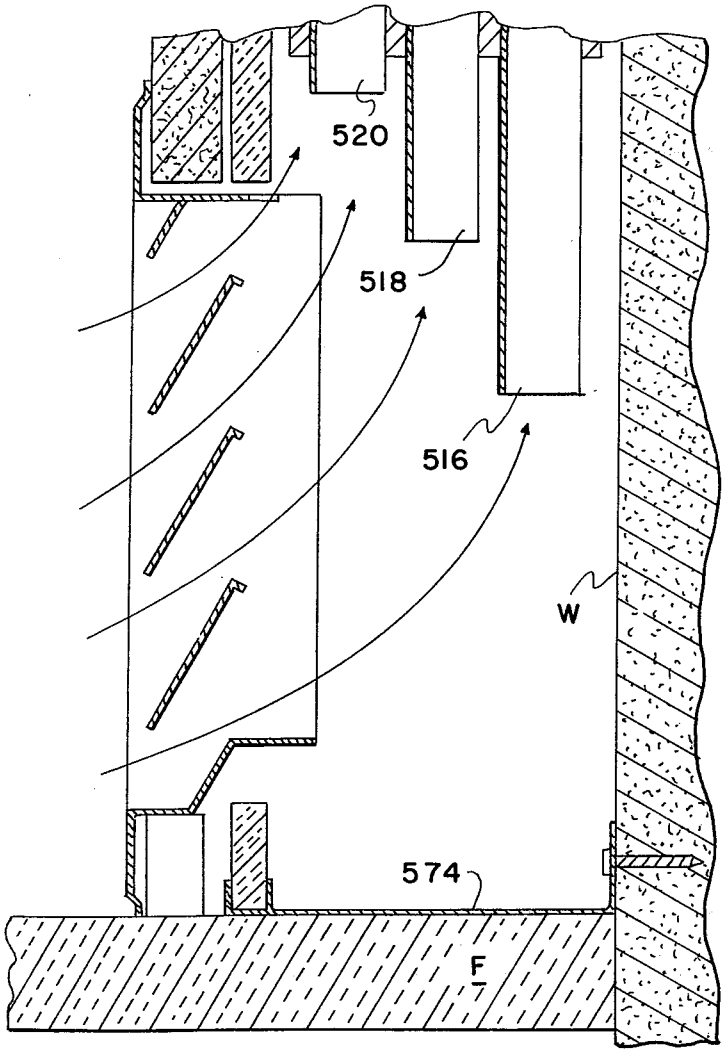

FIGS. 7 and 8 show vertical-section details of the second embodiment. Top and bottom caps 572 and 574 hold the asbestos board in the same manner as the end caps, and header insulation (FIG. 7) is supplied in the form of fibreglass 576 held in the space defined by the top cap 572, the end caps, the asbestos board 562 and metallic inside trim plate 560 which freely overlaps the louvre and adjacent structure for expansion purposes. In this embodiment the core plates 516, 518, 520 are successively shorter toward the front, enhancing the correspondence with the respective louvres.

Figure 9:
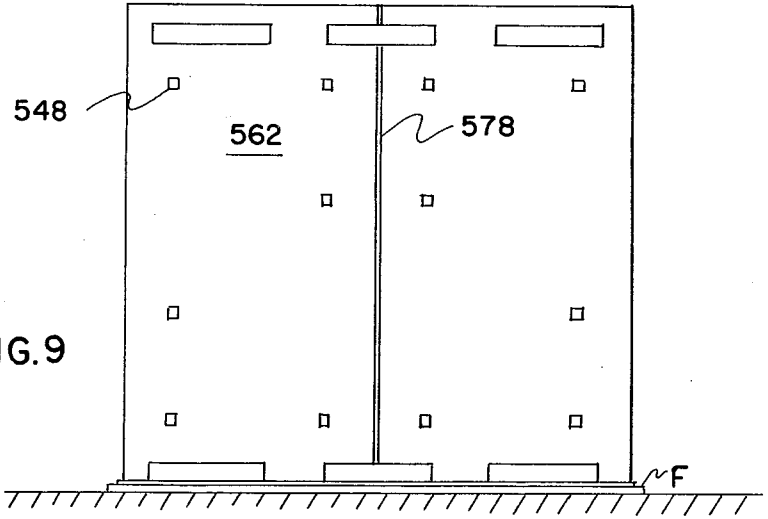
FIG. 9 is a rear elevation of elements of the second embodiment of the invention.

FIG. 9 is a rear elevation of asbestos boards 562 edge-joined by H-section molding 578 in a wide panel assembly, and with J shaped bracket hangers 548 for mounting and supporting the core panels in the same manner previously described in relation to the wall structure.

Figure 10:
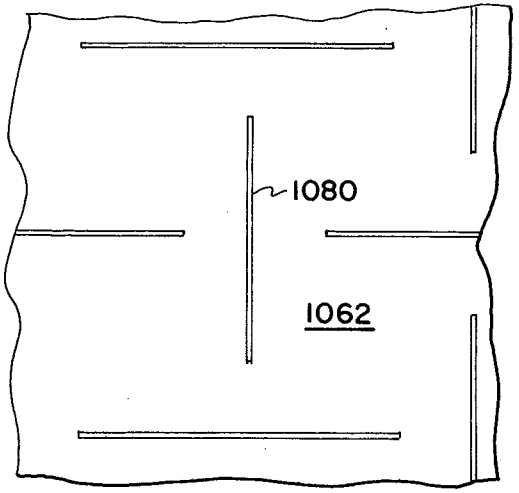
FIG. 10 is a fragmentary elevational detail of an alternative panel-configuration.

FIG. 10 shows another step according to this invention to prevent buckling by localized heating by a fireplace or other freestanding heating unit.

Slots 1080 may be cut through the asbestos board 1062 as shown, in the pattern of a rectangular grid of interrupted straight-line slots, the ends of the slots in each direction perpendicular to and spaced from the midpoints of slots in the other direction.

Figure 11:
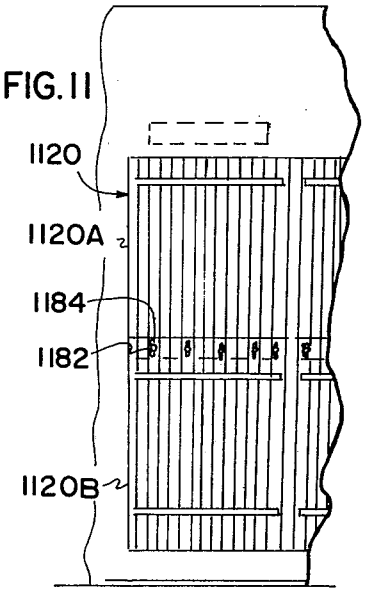
FIG. 11 is a fragmentary elevational detail of a panel configuration.

FIG. 11 shows further anti-buckling structure. The outermost core panel 1120 consists of two portions 1120A and 1120B lapped in the middle at a horizontal seam and slidably held together by rivets 1182 in vertical slots 1184 to permit differential vertical expansion.

From the foregoing various further advantages will be apparent.

Only the edge trim and face panels need to be assembled on location, according to this invention.

Panel assemblies of any desired size can be constructed easily and installed quickly, either flat or in corners with one panel assembly abutting another at right angles, or, if desired, with a corner filler similar to the fiberglass filled header described.

Height of the assemblies can be as low as six feet six inches, or they can go to the ceiling if preferred, and they can be used with or without a hearth.

Heat transfer between the heating unit and the air in the room is far more efficient than with the heating unit adjacent a bare wall, or even located somewhat out into the room, as evidenced by the low temperature of the wall over which the invention is installed, as compared with the warmer wall temperatures encountered without the invention.

The area-increasing anti-buckling corrugations also tend to direct the air upward rather than across, but do not prevent some flow across the panels to relieve local hot spots as would interior barriers.

Obviously many modifications and variations of the present invention are possible in light of the above teachings. It is, therefore, to be understood that within the scope of the appended claims the invention may be practiced otherwise than as specifically described.

What is claimed and desired to be secured by United States letters patent is:

1. A stove and fireplace shield for installation over a building structure vertical wall or the like in spaced relation with a freestanding stove or fireplace or the like comprising: a face panel having an intake aperture therein at the bottom and an exit aperture therein spaced downward from the top, a plurality of metallic core panels, covered by the face panel means for holding the face panel in proximate parallel-spaced relation to a said vertical wall with the plurality of core panels in proximate generally parallel-spaced relation therebetween forming a panel assembly with a plurality of vertical air passages layered over said wall and leading from proximate the intake aperture to the exit aperture: means for closing the ends of said panel assembly, a top cap for closing the top of said panel assembly, all said plurality of core panels being laterally corrugated, the corrugations in all said core panel substantially corresponding in lateral location, and the intake aperture and the exit aperture respectively having a plurality of louvres, each louvre being angled substantially in alignment with a respective vertical air passage.

2. A stove and fireplace shield for installation over a building structure vertical wall or the like in spaced relation with a freestanding stove or fireplace or the like comprising: a face panel having an intake aperture therein at the bottom and an exit aperture therein at the top, a plurality of metallic core panels, all said plurality of core panels being laterally corrugated, the corrugations in all said core panel substantially corresponding in lateral location, means for holding the face panel in parallel-spaced relation to a said vertical wall with the plurality of core panels in generally parallel-spaced relation therebetween forming a panel assembly with a plurality of vertical air passages layered over said wall and leading from proximate the intake aperture to the exit aperture said means for holding including a plurality of tie bars tangent to said corrugations, at least one of said tie bars having means for attachment on one side to a corrugation ridge of a first core panel and on a second side to a corrugation ridge of a second core panel, at least one end cap for closing an end of said panel assembly, and a top cap for closing the top of said panel assembly.

3. A stove and fireplace shield as recited in claim 2, the locations of attachment being laterally spaced.

4. A stove and fireplace shield as recited in claim 3, said means for attachment including a slotted hole through one of said core panels, and a member slidably engaging said slotted hole.

5. A stove fireplace shield as recited in claim 4, said core panel having the slotted hole comprising overlapping upper and lower panel portions, and said slotted hole being vertically slotted and passing through said overlapping portions.

6. A stove and fireplace shield as recited in claim 3, the exit aperture having a plurality of louvres, and a deflector upwardly and outwardly sloped in alignment with louvres of the exit aperture at the upper end of said air passages.

7. A stove and fireplace shield as recited in claim 3, and an asbestos board substantially coextensive with the face panel in size and shape, said asbestos board located between the face panel and the metallic core panel next adjacent to the face panel.

8. A stove and fireplace shield as recited in claim 7, said at least one end cap having a pair of inwardly turned spaced flanges supportively engaging an edge of said asbestos board.

9. A stove and fireplace shield as recited in claim 7, wherein the asbestos board has a plurality of anti-buckling slots therethrough in the pattern of a rectangular grid of straight-line slots, the ends of the slots in each direction perpendicular to and spaced from the midpoints of the slots in the other direction.

10. A stove and fireplace shield as recited in claim 7, said face panel being of ceramic construction and affixed to the asbestos board.

11. A stove and fireplace shield as recited in claim 2, said means for holding including at least one bracket mounted on a said building structure vertical wall and engaging a said tie-bar slidably in a horizontal direction.

* * * * *